United States Patent [19]

Eskeli

[11] 4,178,766

[45] Dec. 18, 1979

[54] THERMODYNAMIC COMPRESSOR METHOD

[76] Inventor: Michael Eskeli, 7994-41 Locke Lee, Houston, Tex. 77042

[21] Appl. No.: 884,832

[22] Filed: Mar. 9, 1978

Related U.S. Application Data

[62] Division of Ser. No. 708,863, Jul. 26, 1976, Pat. No. 4,107,945.

[51] Int. Cl.[2] ..... F25B 3/00

[52] U.S. Cl. ..... 62/88; 62/499; 62/501; 165/88; 165/DIG. 12

[58] Field of Search ..... 62/86–88, 62/401, 499, 501; 60/650, 682; 415/178; 165/88, 90, DIG. 12; 417/53, 243, 247

[56] References Cited

U.S. PATENT DOCUMENTS

| | | | |
|---|---|---|---|
| 2,714,289 | 8/1955 | Hofmann | 60/650 |
| 3,293,850 | 12/1966 | Morrison | 60/650 |
| 3,327,495 | 6/1967 | Ergenc | 62/88 |
| 3,470,704 | 10/1969 | Kantor | 62/499 |
| 3,986,361 | 10/1976 | Eskeli | 415/178 |
| 4,010,018 | 3/1977 | Kantor | 62/499 |
| 4,050,253 | 9/1977 | Eskeli | 60/650 |

FOREIGN PATENT DOCUMENTS

| | | | |
|---|---|---|---|
| 936059 | 9/1963 | United Kingdom | 165/90 |

*Primary Examiner*—Sheldon Jay Richter

[57] ABSTRACT

A method for the thermodynamic assisted compression of gases wherein a gas is alternately compressed and expanded with addition of heat regeneratively. The basic method is applicable to a variety of uses such as gas compression, turbines and in heat temperature boosters. Working fluids may be either gases or vapors. Heat may also be removed during compression steps and added during expansion steps. Process can be used with both steady flow and non-flow apparatus.

8 Claims, 6 Drawing Figures

THERMODYNAMIC COMPRESSOR METHOD

CROSS REFERENCES TO RELATED APPLICATONS

This application is a divisional application of "Thermodynamic Compressor", filed 7/26/76, Ser. No. 708,863, now U.S. Pat. No. 4,107,945.

BACKGROUND OF THE INVENTION

This invention relates generally to means to compress compressible fluids, such as compressible gases and vapors, wherein the fluid is alternately compressed and expanded, with the addition of heat during such compression and expansion steps. The Heat being added is usually obtained from the same working fluid regeneratively.

SUMMARY OF THE INVENTION

It is an object of this invention to provide a method and apparatus where the pressure of a working fluid is increased with reduced work input, by adding heat into the working fluid in a step type heat addition process, with alternate compression and expansion steps for the working fluid. The heat added into the working fluid is usually obtained by removing the heat from the heated and pressurized working fluid regeneratively. The compression and expansion steps are usually carried out in a non-flow type thermodynamic process; steady flow process may be also used with lesser efficiency.

DESCRIPTION OF PREFERRED EMBODIMENTS

Figure 1:
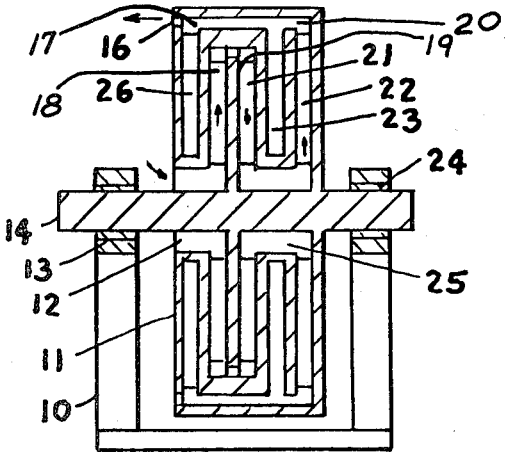
FIG. 1 is a cross section of one form of the apparatus.

Referring to FIG. 1, there is shown a centrifuge type rotor for the pressurization of compressible working fluids. 10 is base, 11 is rotor, 12 is fluid inlet, 13 and 24 are bearings supporting shaft 14, 26 is fluid space with optional vanes, 16 is fluid exit, 17 is fluid passage, 18 is a vane in working fluid outward extending passage, 19 is divider wall, 20 is fluid opening, 21 is vane in fluid inward extending passage, 22 is vane in outward extending fluid passage, 23 is fluid space with optional vane, 25 is fluid center passage.

Figure 2:
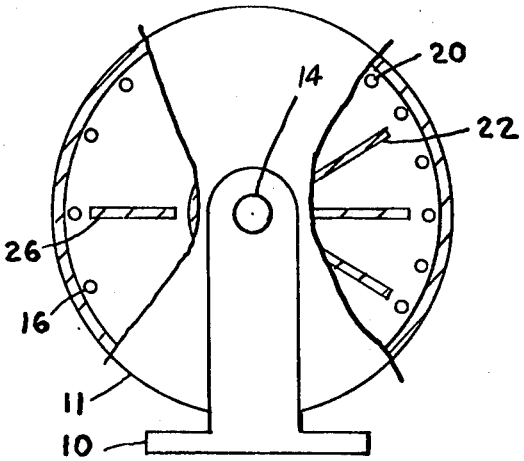
FIG. 2 is an end view of the same unit.

In FIG. 2 an end view of the unit of FIG. 1 is shown. 10 is base, 11 is rotor, 16 are fluid exit openings, 26 is fluid space vane, 14 is shaft, 20 are fluid openings, 22 are vanes.

Figure 3:
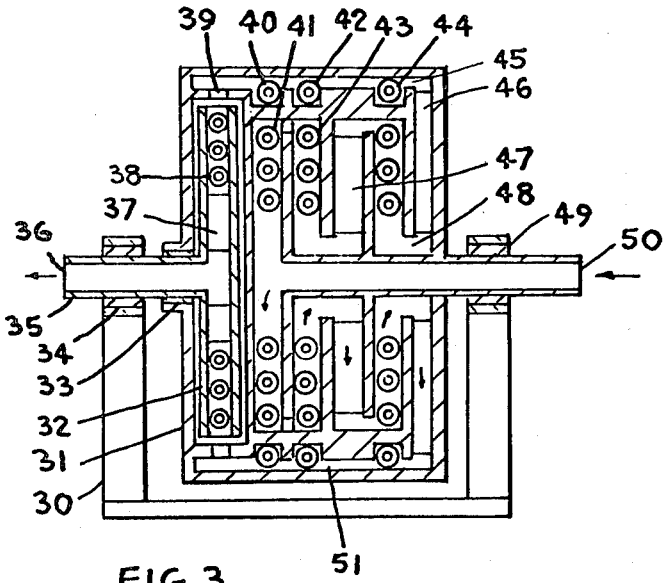
FIG. 3 is a cross section of another form of the apparatus.

In FIG. 3, a cross section of another form of the apparatus is shown, with the regenerative heat exchangers being formed from finned tubing, and a means for extracting work from the compressed fluid before discharge by using a second rotor. Also, a means is provided for heat addition from external sources within the second rotor, if the unit is used as a turbine. 30 is base, 31 is first rotor, 32 is second rotor, 33, 34 and 49 are bearings, 35 is shaft, 36 is fluid exit, 37 is vane within second rotor, 38 is heating coil, 39 are fluid openings which are usually nozzles, 40 and 41 are parts of a regenerative heat exchanger, 42 and 43 are parts of another step of a regenerative heat exchanger, 44 is another regenerative heat exchanger, 45 is fluid opening, 46 and 47 are vanes in their fluid passages, 48 is fluid passage, 50 is fluid entry, 51 is fluid passage.

Figure 4:
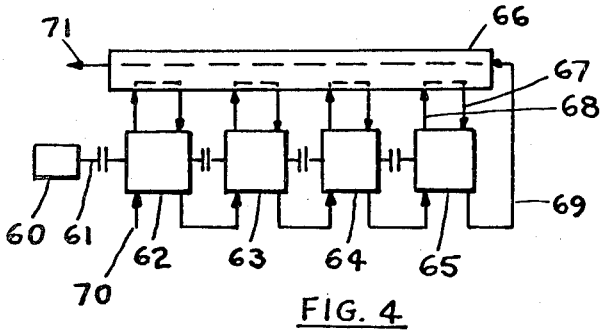
FIG. 4 is a fluid pressurization system using a similar process and using any type of apparatus.

In FIG. 4, a system using the same work process shown for the centrifuge type apparatus, is illustrated. The heat is added into the working fluid regeneratively, and the fluid undergoes alternate expansion and compression, with heat addition. 60 is power unit, connected by shaft 61 into the apparatus, 70 is fluid entry, 69 is fluid conduit and 71 is working fluid exit, 62 and 64 are compressors and 63 and 65 are expanders, being heated by a heat transfer fluid being circulated from heat exchanger 66 via conduits such as 67 and 68. Usually, numerous steps of compression and expansion are required to obtain desired pressure gain, and the number of compression and expansion components may be as desired. Also, it should be noted that the heat can be transferred directly in the compression-expansion components from the working fluid into the working fluid stream being compressed, thus eliminating the heat transfer fluid.

Figure 5:
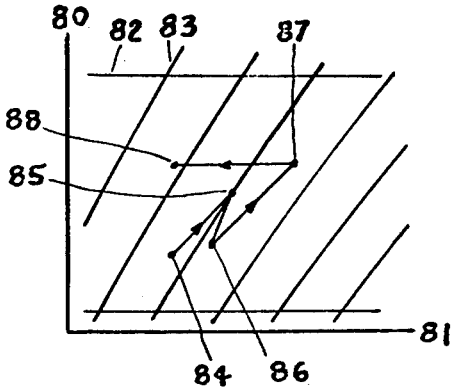
FIG. 5 is a pressure-enthalpy or internal energy diagram for a typical working fluid with the work cycle for a pressure increaser shown thereon.

In FIG. 5, a pressure-enthalpy or internal energy diagram is shown with a typical work cycle for the apparatus illustrated thereon. 80 is pressure line and 81 is enthalpy or internal energy line, 82 is constant pressure line and 83 is constant entropy line. The work cycle is 84-85-86-87 and 88, with the fluid entering at 84 and leaving at 88. The heat addition is shown to be carried out both during compression and expansion, but heat can be added both during compression only, and during expansion only, as desired. The work cycle shown is applicable to the apparatus of FIG. 1.

Figure 6:
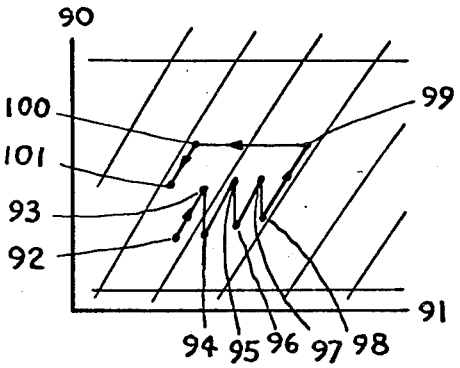
FIG. 6 is another pressure-enthalpy or internal energy diagram with a work cycle shown thereon.

In FIG. 6, another pressure-internal energy or enthalpy diagram is shown. 90 is pressure line and 91 is enthalpy or internal energy line. The work cycle is 92-93-94-95-96-97-98-99-100-101. The working fluid enters at 92 and leaves at 101, which is shown for a typical compressor use. The line 100-101 can be extended to the same pressure as point 92, which would be for a typical turbine use; also, in such use, the lines 92 and 100-101 are usually isentropic, following the constant entropy line, and without heat addition or removal to reduce the cost of manufacture of the apparatus.

In operation, the rotor is caused to rotate, and the fluid enters the rotor via entry 12, and is compressed in outward extending passages formed by vanes 18 which usually also serve as heat exchange members, then the fluid is expanded in passages 21 with vanes serving to improve heat transfer, then the fluid is compressed again in passages 22 with the vanes improving heat transfer, and then the fluid passes along peripheral passages 17 to exit openings 16, and also serves as a heat source for the fluid being compressed via fluid spaces 23 and 26. The spaces 23 and 26 are open into the peripheral fluid passage 17 and allow the heated working fluid enter the spaces, thus serving as the heat source for the fluid fluid being compressed. In spaces 23 and 26, centrifugal force together with density changes in the working fluid provide for fluid circulation.

In FIG. 6, the heat is added into the working fluid during expansion, while during compression, for most of the steps, the process is with heat removal. The heat removal can be produced with apparatus such as is shown in FIG. 1, where heat may be removed during compression through wall 19 and passed directly to the expanding fluid in passage 21. Similarly, heat may be removed through the wall from passage 22 to to passage 23 and from there to passage 21. Where heat transfer is not desired, the walls can be thermally insulated. Similarly, the finned tubes of FIG. 3 may be so connected as to provide for heat removal during fluid compression, and heat exchange during expansion and compression steps.

The finned tubes of FIG. 3 are usually filled with a liquid fluid and connected in a closed loop to form a heat transfer means from the outer fluid passage into the fluid being compressed or expanded in the inner passages. Also, one may leave the heat exchangers out, as is done in passage 47 of FIG. 3, thus providing for approximately isentropic process. The heat exchanger 38 may be provided when the unit is used as a turbine with a heated heat transfer fluid supplied from external sources through shaft passages; also, the heat exchanger 38 may be provided in compressor applications if desired.

Applications for this device include as a fluid pressurizer, power generator, thrust generator, and generally as a component in any rotary or other device where it is desired to increase the pressure of the working fluid; one component type application obviously is in the compression stage of gas turbines, particularly for the type apparatus shown in FIG. 1.

The compression and expansion steps are shown to be approximately equal in magnitude in the pressure-internal energy diagrams. The steps do not need be equal; various amounts of compression and expansion may be applied as desired, and the amount of heat added and removed, per step, may be as desired.

The openings 16 of FIG. 1, may be nozzles. These nozzles may be directed to discharge the fluid in a desired direction, including axially and either forwardly or backwardly as may be required for the unit operation.

The system of FIG. 4 can also be used to increase the pressure of a fluid, and may be used as a component in systems such as a gas turbine. Thus, the method used in the rotary units of FIG. 1 and FIG. 3, may be also used by any type apparatus ordinarily used for compression and expansion of gases, and is particularly suited for non-flow positive displacement type equipment. In operation, the system of FIG. 4, the working fluid is alternately expanded and compressed, with heat addition usually during both compression and expansion, or heat addition between the expansion and compression steps at constant volume. Heat removal may also be carried out during compression. The system of FIG. 4 may be either a non-flow or steady flow type as desired.

I claim:

1. A method of compressing a compressible fluid comprising:

a. alternately compressing and expanding said fluid in a first compressing and expanding means; subsequently b. compressing said fluid in a second compressing means with accompanying temperature increase;

c. removing heat from said fluid downstream of the second compressing means and adding said heat into said fluid during the alternate compressing and expanding steps, within either said first compressing or expanding means.

2. The method of claim 1 wherein the heat addition into said fluid during the alternate first compression or (and) expansion is within said expanding means.

3. The method of claim 1 wherein the heat removal from said fluid downstream of the second compressing means is at approximately constant pressure.

4. The method of claim 3 wherein said heat removal at approximately constant pressure is performed within a centrifuge type machine.

5. The method of claim 1 wherein a separate heat transfer fluid is provided for removing the heat from the fluid downstream of the second compressing means and adding said heat into the fluid during the first alternate compressing or expanding means.

6. The method of claim 1 wherein the heat addition into said fluid during the alternate compression and expansion is within said first compressing means.

7. The method of claim 1 wherein said fluid is further expanded in another expansion means downstream of the heat removal and second compressing steps.

8. The method of claim 1 wherein in the first alternate compressio or expansion steps the work input during the compression and the work output during the expansion by the said fluid are approximately equal.

* * * * *